United States Patent [19]

Shook et al.

[11] Patent Number: 4,753,549

[45] Date of Patent: Jun. 28, 1988

[54] METHOD AND APPARATUS FOR REMOVING STRUCTURAL CONCRETE

[75] Inventors: Forrest A. Shook, Fenton; Gerard J. DeSantis, Battle Creek, both of Mich.

[73] Assignee: NLB Corporation, Wixom, Mich.

[21] Appl. No.: 902,234

[22] Filed: Aug. 29, 1986

[51] Int. Cl.[4] ..... E01C 23/12; E21C 37/12

[52] U.S. Cl. ..... 404/75; 404/90; 299/17; 299/41; 239/227; 239/752; 175/424

[58] Field of Search ..... 404/75, 90, 91; 299/17, 299/36, 41; 239/148, 160, 162, 227, 752; 175/67, 422

[56] References Cited

U.S. PATENT DOCUMENTS

| | | | |
|---|---|---|---|
| 2,106,035 | 1/1938 | Mall | 299/41 X |
| 2,684,558 | 7/1954 | Harris et al. | 51/424 |
| 3,231,031 | 1/1966 | Cleary | 175/422 R X |
| 3,614,163 | 10/1971 | Anderson | 299/14 |
| 3,688,853 | 9/1972 | Maurer et al. | 175/422 R |
| 3,778,109 | 12/1973 | Anderson et al. | 299/14 |
| 3,792,907 | 2/1974 | Anderson | 299/17 |
| 3,796,463 | 3/1974 | Naydan et al. | 299/14 |
| 3,811,795 | 5/1974 | Olsen | 417/53 |
| 3,857,516 | 6/1974 | Taylor et al. | 239/186 |
| 3,905,608 | 9/1975 | Olsen et al. | 277/188 |
| 3,960,407 | 6/1976 | Noren | 299/17 |
| 4,026,322 | 5/1977 | Thomas | 137/512 |
| 4,081,200 | 3/1978 | Cheung | 299/17 |
| 4,111,490 | 9/1978 | Liesveld | 299/17 |
| 4,119,160 | 10/1978 | Summers et al. | 175/422 R X |
| 4,195,885 | 4/1980 | Lavon | 299/1 |
| 4,204,715 | 5/1980 | Lavon | 299/16 |
| 4,219,155 | 8/1988 | Goerss | 239/124 |
| 4,221,271 | 9/1980 | Barker | 175/422 |
| 4,289,275 | 9/1981 | Lavon | 239/101 |
| 4,683,684 | 8/1987 | Yie | 299/41 X |

*Primary Examiner*—George A. Suchfield
*Assistant Examiner*—John F. Letchford
*Attorney, Agent, or Firm*—Cullen, Sloman, Cantor, Grauer, Scott & Rutherford

[57] ABSTRACT

The method and apparatus for removing structural concrete from a road bed includes a vehicle having a frame on wheels movable along a road bed and mounting a pivotal hood having a lowered use position adjacent the road bed and a raised position. A pressure water manifold upon the frame is connected to a source of pressurized water up to 25,000 p.s.i. A feed carriage is reciprocally mounted within the hood and supports a rotating seal and shaft assembly having a body with a water inlet connected to the manifold and a power rotated tubular shaft journaled upon the body receiving pressure water for delivery to a depending nozzle block connected to and depending from the shaft. The nozzle block normally has one or a pair of angularly related elongated bores arranged at an acute angle to the vertical axis of the blaster shaft including converging nozzles whereby the sequential and pulverizing action of water in a rotating pattern impinges against the concrete of the road bed under high pressure and traveling back and forth over the road bed removes structural concrete to a required depth and further removes surface scale and corrosion from the concrete reinforcing bars without damage thereto.

25 Claims, 6 Drawing Sheets

METHOD AND APPARATUS FOR REMOVING STRUCTURAL CONCRETE

FIELD OF THE INVENTION

The present invention relates to an apparatus in the form of a vehicle having a frame on wheels movable along a road bed for movably mounting within a hood upon the frame a rotating seal and shaft assembly which is connected to a pressure water manifold providing water pressures up to 25,000 p.s.i., as an example. The rotating assembly includes a tubular shaft having depending nozzle(s) for delivering pressurized water for impingement against concrete to be removed from a road bed. The apparatus may operate in an automatic mode or a manual mode.

BACKGROUND OF THE INVENTION

Heretofore one generally accepted method of breaking up a roadway or concrete was the use of jack hammers employed by a number of men working on a road surface. Often the jackhammer would engage the reinforcing bars and damage them to cause a rapid corrosion of the reinforcing bars. Often the reinforcing bars found embedded within the concrete required sandblasting for cleaning purposes to remove scale and corrosion in order to condition the bars to form a strong bond for a fresh application of concrete. The use of jackhammers created undesired cracks in adjacent concrete and large amounts of airborne dust were created.

As time went on various apparatuses were provided for breaking up concrete of a road bed which employed fluids such as disclosed in U.S. Pat. No. 4,081,200, dated Mar. 18, 1978 entitled "Method and Apparatus to Remove Structural Concrete". In devices of this nature which employed the use of water there was the difficulty of providing water under sufficient pressure and velocity to provide the cutting and breaking up action necessitated in order to commercially remove structural concrete from a road bed at the same time without damaging the related reinforcing bars and without damaging adjacent good concrete.

Another pressure water cleaning device for floors and gratings is disclosed in U.S. Pat. No. 4,219,155 of Aug. 26, 1980, assigned to the assignee of record, where pressurized water in a pattern is applied to a surface for cleaning purposes as it moves over the surface. Other prior art patents for cleaning road ways and for breaking up concrete using pressurized water or other forces are disclosed in the accompanying Information Disclosure Statement.

SUMMARY OF THE INVENTION

An important feature of the present invention is to provide a method and apparatus, which may have a manual mode or an automatic mode, for removing structural concrete from a road bed where the action of the water jetting against the concrete in a systematically controlled manner under high pressures results in areas of structural concrete being removed to required depths through one or more levels of aggregate efficiently and with safety to the basic structure and to attendant personnel.

Another important feature of the present method and apparatus includes the use of high pressure rotating jets systematically traveling back and forth over the work area allowing for removal of concrete under controlled conditions. The operation can be performed without danger of cutting into and weakening embedded reinforcing bars and without damaging the concrete in adjoining areas. Only the weakened concrete is removed until you reach good sound concrete that doesn't need replacing, without disturbing the surrounding concrete, and without introducing dust pollution into the air.

Still another important feature is to provide an apparatus for removing structural concrete from a road bed comprising a vehicle having a frame with wheels movable upon and along the road bed in uniform forward increments and including a transversely elongated hood which is pivotally mounted upon one end of the frame, with a rotating seal and shaft assembly movable incrementally along the length of the hood and including a rotatable tubular shaft having depending rotatable nozzle(s). In such an apparatus, the hood has a lowered operative position closely adjacent the road bed and an elevated position and a pressure water manifold is mounted upon the frame and connected to a source of pressurized water. The rotating seal and shaft assembly is effective to deliver pressurized water through the rotating nozzle(s) for impingement against concrete to be removed from a road bed.

A further feature includes a feed carriage guidably mounted upon and within the hood for continuous longitudinal or side way reciprocal movements along the length of the hood, the carriage mounting a rotating seal and shaft assembly including a body having a water inlet connected to the manifold mounted within and upon a carriage and having a power rotated tubular shaft journaled and supported within the body and depending therefrom below the carriage and hood and at one end communicating with the water inlet and with the shaft mounting at least a single nozzle block having a tubular shank upon a vertical axis which is projected into and secured within the shaft and which includes an elongated bore extending to the end of the block at an acute angle to its axis.

Another feature includes a nozzle having a converging orifice communicating with the bore and which is secured within the nozzle block outletting at its end face wherein the sequential penetrating and pulverizing action of water in a rotating pattern impinging against the concrete under high pressure and traveling back and forth over the work area removes structural concrete to a required depth without damage to preexisting reinforcement bars. The pressurized water enters between and beneath the aggregate particles not only removes the concrete immediately surrounding embedded reinforcing bars but it also effectively remove surface scale and corrosion from such bars, conditioning them to form a strong bond with fresh concrete to be poured around them. Incidence angle of the rotational water jets to the concrete surface may be varied as to enhance the removal action in places otherwise difficult to reach such as beneath and behind reinforcing bars or composites of such bars.

As another feature of the present invention, the hood is pivotally mounted upon the frame by laterally spaced brackets and a pair of spaced lift cylinder assemblies upon opposite sides of the frame includes cylinders pivotally mounted upon the frame and reciprocal piston rods pivotally connected to the hood with the controlled advance of the piston rods pivoting the hood to an elevated position and on retraction with the piston rods moving the hood to a lowered use position.

Another feature is to provide with the apparatus for removing structural concrete a source of pressurized water including a water storage and pump vehicle movable upon the road bed and including a supporting bed mounting a water storage tank and a power operated pump connected to the tank together with a pump discharge manifold connected to the tank and having a high pressure water outlet adapted for connection by an elongated flexible hose having fittings to the pressure water manifold on the vehicle apparatus which mounts the rotating seal and shaft assembly and the depending rotatable nozzle(s).

Still another feature includes the guide mounting of the feed carriage for reciprocal movements in increments along the length of the hood with the rotating seal and shaft assembly and the depending rotating nozzle(s) supportably mounted upon the carriage whereby jets of pressurized water are delivered by the nozzle block and the nozzle with orifice or orifices therein for impinging high pressure water over the road bed surface for breaking up concrete and removing structural concrete to a required depth.

A further feature includes a power spiral operator for translating rotary movement of a power operated shaft to longitudinal feed movement of the carriage and wherein a plurality of skewed rollers upon the feed carriage frictionally engage the shaft. A reversal of shaft rotation will reverse direction of the actuator travel and corresponding travel of the carriage mounting the rotating seal and shaft assembly.

A still further feature provides for the shaft for the water seal and shaft assembly a separately operable power drive mounted upon the carriage and directly connected to the shaft for driving the shaft selectively in two directions and at variable speeds under remote control for the hydraulic motor.

Another feature is to provide a rotating nozzle block having an end face and a tubular shank arranged on a vertical axis projected into and secured within the shaft and communicating therewith and which has one or more angularly related bores for delivering pressurized water to corresponding nozzles having converging orifices for outletting at the end face of the nozzle block and for providing a rotating water pressure pattern impinging against concrete under high pressure and adapted for traveling back and forth over a work area while undergoing rotation for removing concrete to a required depth.

Still another feature of the present invention is to provide a novel method of removing structural concrete from a road bed which comprises mounting a vehicle apparatus upon the road bed for longitudinal intermittent incremental forward feed movements thereover, pivotally supporting a hood upon the vehicle apparatus having a lowered use position closely adjacent the road bed and positioning a pressure water manifold upon the vehicle apparatus connected to a source of pressurized water in a high pressure range for delivering pressurized water for impingement against the concrete to be removed from the road bed.

A further feature includes the additional steps of movably mounting a feed carriage upon and within the hood for transverse reciprocal movements along the length thereof and mounting a rotating seal and shaft assembly upon the carriage which includes a power rotated shaft and the further step of supporting at least one nozzle block having an angular bore and an orifice for connection to and rotation with the shaft sequentially penetrating and pulverizing the concrete by impingement of high pressure rotating water jets upon the concrete or road bed surface with the rotating seal assembly reciprocating back and forth over the work area for removing structural concrete to a required depth and removing surface scale and corrosion from the concrete reinforcing bars.

Another feature is to provide a unitary elongated nozzle block having an end face and a tubular shank on a vertical axis and including an elongated bore extending to the end of the block at an acute angle to the axis.

Still another feature is to provide a nozzle assembly comprising the aforedescribed nozzle block and a nozzle having a converging orifice communicating with the bore and secured within the nozzle block and outletting at its end face.

A further feature is to provide a novel rotating high pressure seal and shaft assembly with a rotatable shaft, supported by a pair of roller bearings mounted in the bore of a cylindrical body, with the shaft having a passageway for high pressure fluid, and a cover sealingly engaging an end face of the body and enclosing the inlet to the passageway in the shaft.

These and other features and objects will be seen from the following specification and claims in conjunction with the appended drawings.

THE DRAWINGS

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Figure 1:
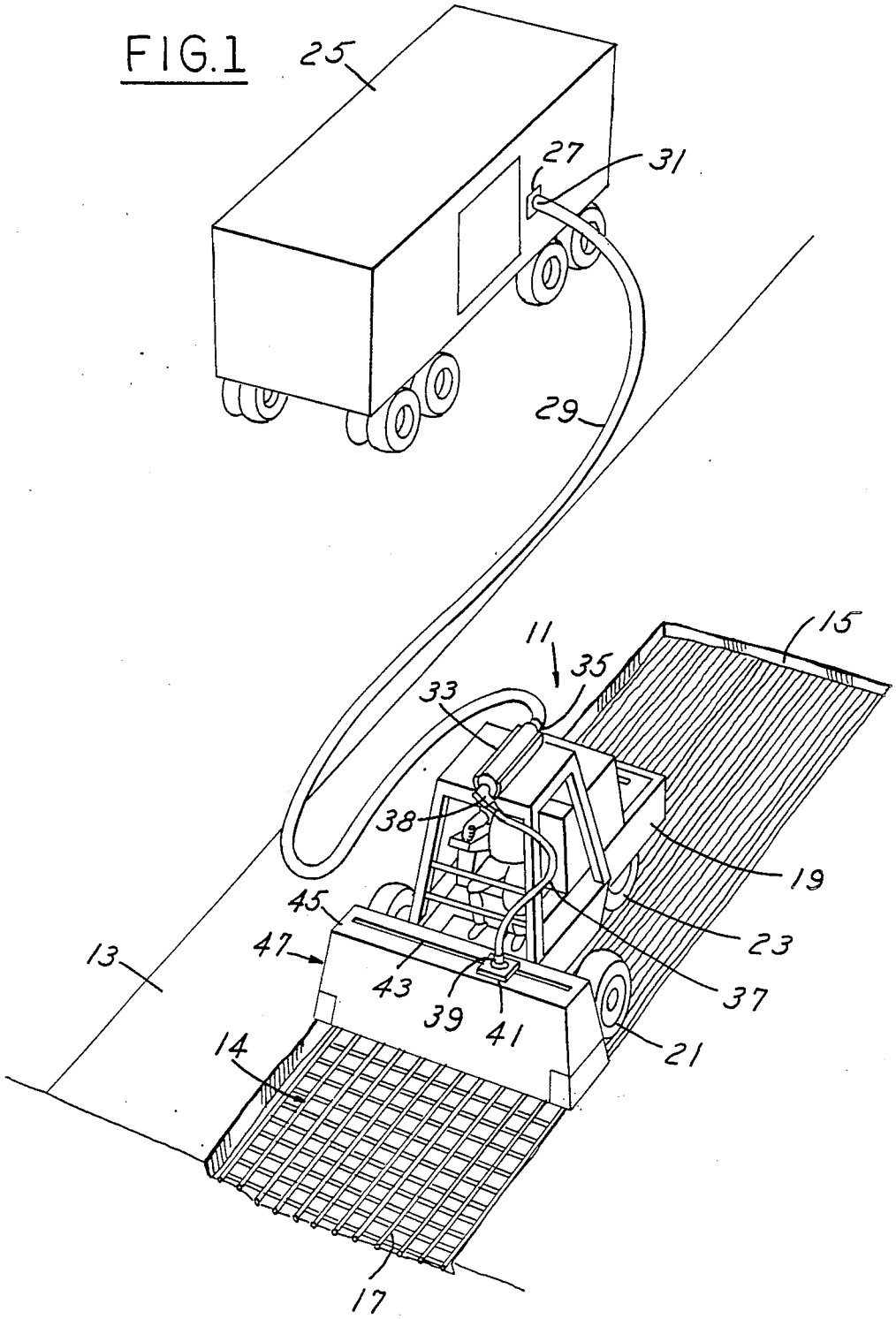
FIG. 1 is a front perspective view of the present apparatus for removing structural concrete from a road bed in conjunction with the water storage and pump vehicle movable upon the bed including an elongated flexible hose having fittings for transmitting pressurized water to the water blaster vehicle or apparatus.

Referring to FIG. 1, a high pressure water blaster apparatus or vehicle 11 is movably mounted for longitudinal feed increments upon the concrete or cement road bed or road surface 13. FIG. 1 also illustrates a water blasted area 14 over which the vehicle 11 has already moved for removing structural concrete over an area defined by substantially the width of the cut away area achieved by longitudinal feed increments of a water blaster assembly.

There is also shown in FIG. 1 in connection with the water blasted area 14 a cut away top layer 15 which may have been removed by an apparatus other than the apparatus 11. The steel reinforcements 17 are exposed in the lower portion of the illustration adjacent the water blasted area 14 of FIG. 1.

The water blaster vehicle 11 has a frame 19 mounted upon wheels including a pair of front wheels 21 and a centrally arranged steering wheel 23 which through internal feed mechanism is adapted to effect incremental longitudinal forward feed movements limited amounts as for example 4" to 6" at a time. With such a construction the water blaster vehicle 11 includes high pressure rotating jets which are adapted to travel back and forth transversely over the work area removing structural concrete to a required depth such as shown at 14, FIG. 1.

Associated with the present water blaster vehicle 11 and mounted upon the road bed 13 or adjacent thereto is a water storage and pump vehicle 25 which has upon one side wall a high pressure water outlet 27, FIG. 1, to which is connected by a quick disconnect fitting 31 a flexible high pressure water hose 29 adapted to carry water under pressures up to 25,000 p.s.i. or the pressure required to remove the concrete. Hose 29 is adapted for connection by a similar quick disconnect fitting 35 to pressure water manifold 33 in the illustrative embodiment supportably mounted upon the roof of the vehicle 11, FIG. 1.

A secondary flexible high pressure water feed conduit 37 with suitable quick disconnect fitting 38 extends from manifold 33 and with an additional fitting 39 extends to support plate 41 slidably positioned over the transverse elongated slot 43 which extends along the length of top wall 45 of the transversely extending hood 47.

The hood 47 is generally of "A" shape or configuration and supportably mounts a suitable carriage 101 mounting the present rotating seal and shaft assembly 77.

Figure 2:
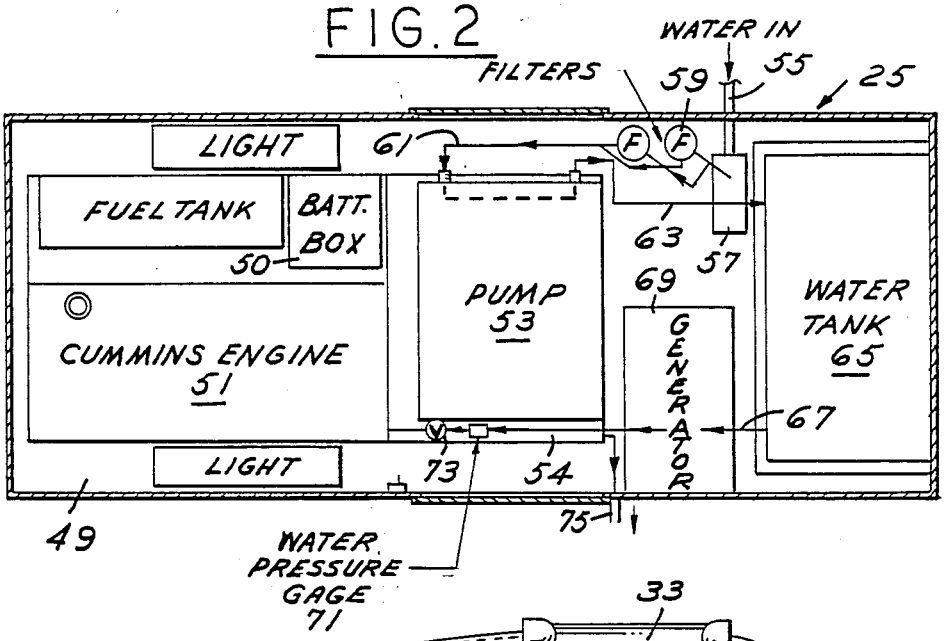
FIG. 2 is a plan schematic view of the vehicle apparatus for storing and pumping pressurized water to the water blaster vehicle or apparatus shown in FIG. 1.

Referring to FIG. 2, the water storage and pump vehicle 25 of FIG. 1 includes a bed 49 having suitable 12 volt batteries 50 and corresponding electric control system, an engine drive 51 such as in the illustrative embodiment a Cummins diesel drive 335 horsepower engine adapted for driving the pump 53. Mounted upon bed 49 is a suitable discharge manifold 54 which communicates with high pressure water outlet 75.

Fragmentarily shown in FIG. 2 is a water supply inlet 55 that communicates with receiver 57 for delivering water through the filters 59, conduit 61 into the pump 53 and from the pump 53 through conduit 63 into the water tank 65. Pressurized water from the tank 65 passes through the 5,000 watt generator 69 in a line 67 which includes water pressure gauge 71 which registers up to 30,000 p.s.i. and which has adjacent thereto a pressure relief valve 73 in the illustrative embodiment set at 20,500 p.s.i.

Figure 5:
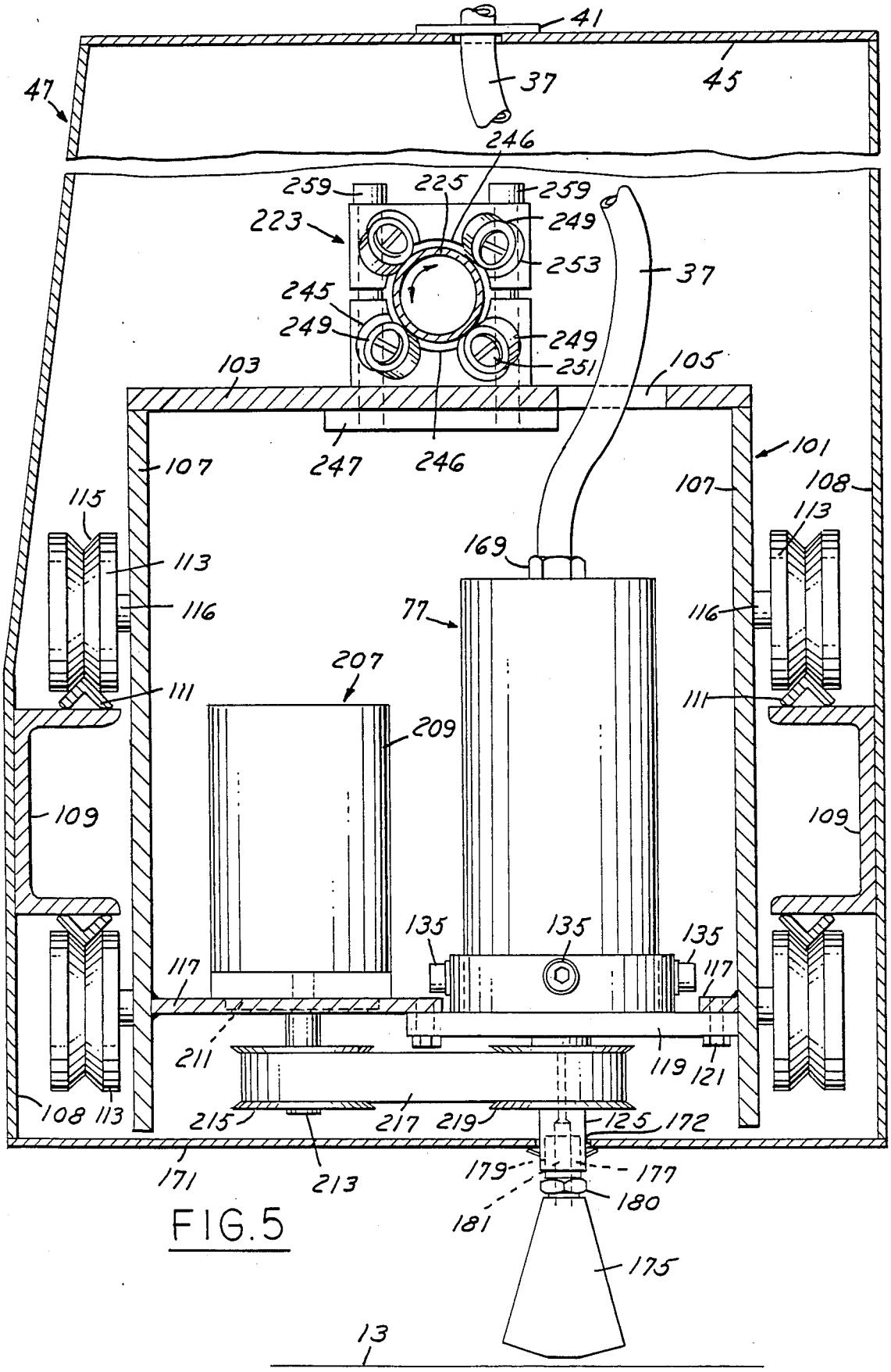
FIG. 5 is a transverse elevational view of the hood and carriage assembly mounting the water blaster apparatus with respect to the road bed surface with portions fragmentarily shown.
Figure 6:
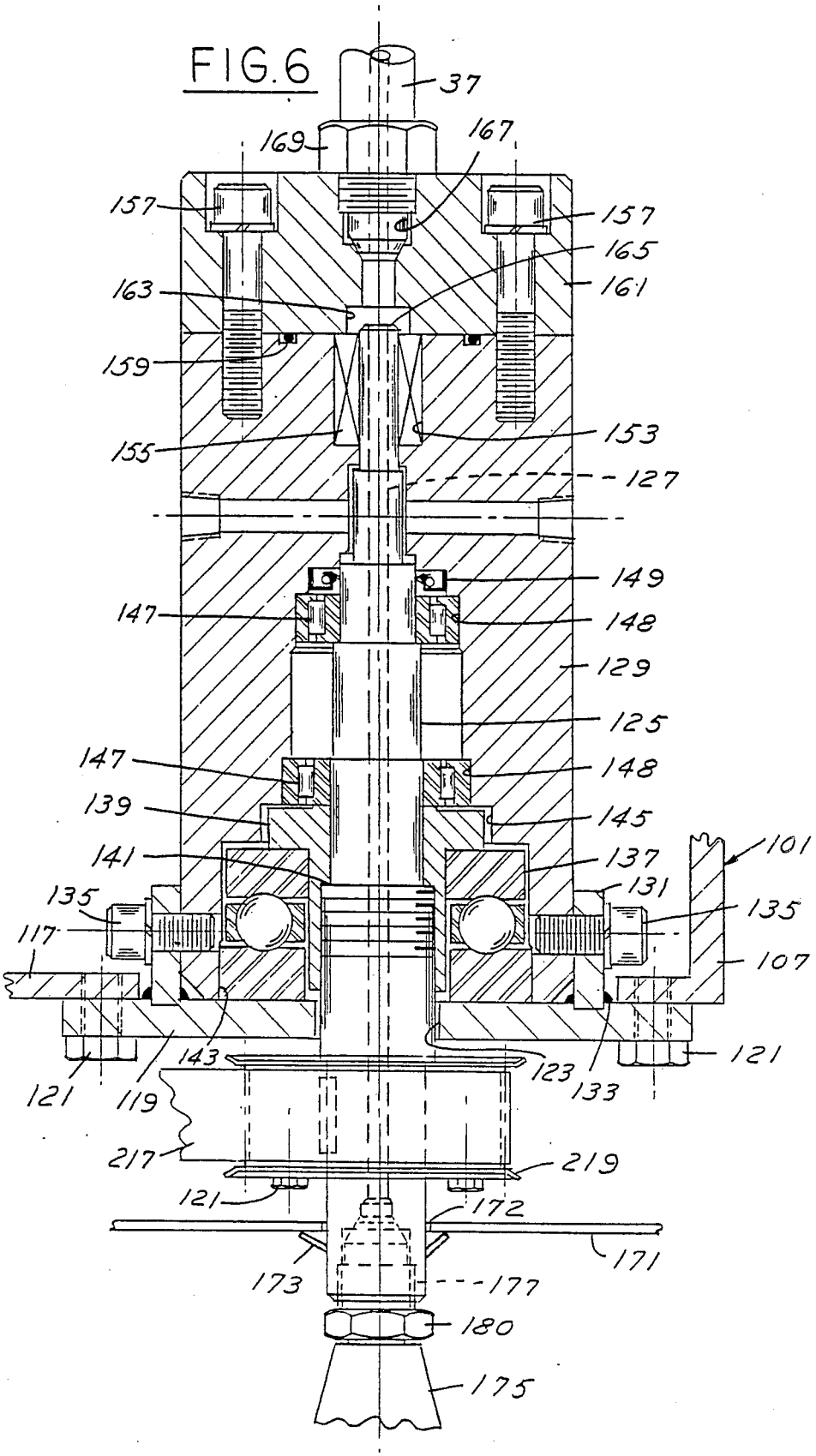
FIG. 6 is a fragmentary longitudinal vertical section of the rotating seal and shaft assembly shown in FIG. 5, on an increased scale.

The high pressure water outlet 75 in FIG. 2 is adapted for connection through fitting 27, FIG. 1, to the high pressure hose or conduit 29 for delivery of the water to the pressure water manifold 33 located upon the water blaster vehicle 11 for subsequent delivery to the rotating seal and shaft assembly 77, shown in FIGS. 5 and 6, supported and mounted upon a carriage located within the hood 47.

Figure 3:
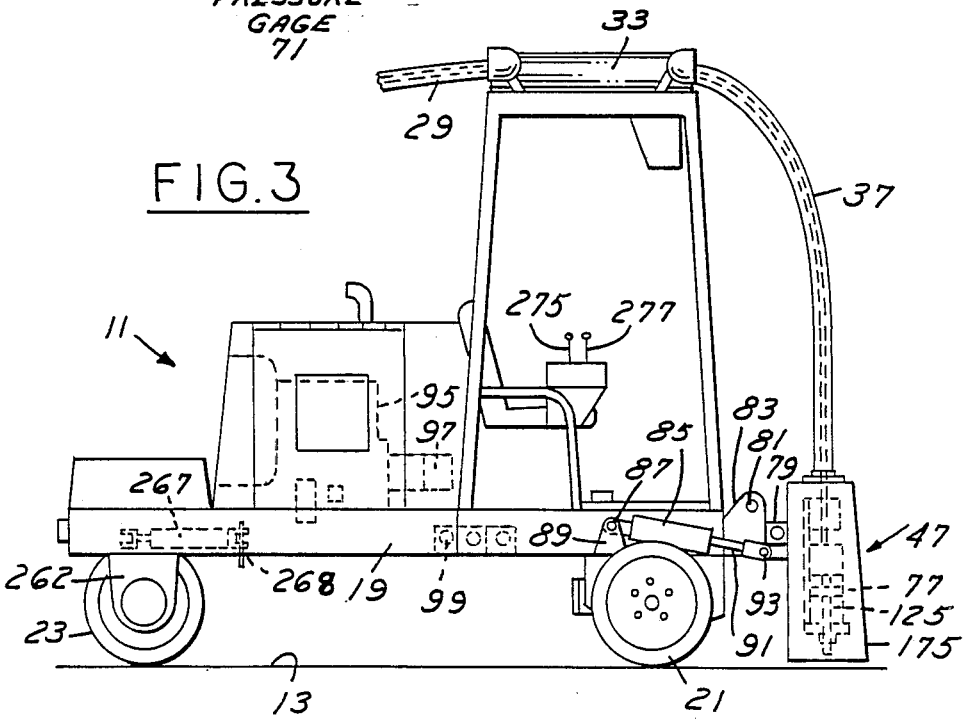
FIG. 3 is a side elevational view of the water blaster vehicle upon the road bed with the water blaster assembly in a use position and movable along the "X" axis.

Hood 47, FIG. 3, extends transversely of frame 19 along the "X" axis and includes a pair of laterally spaced hood supports 79 pivoted at 81 upon a pair of laterally spaced brackets 83 upon one end of frame 19. Control of the positioning of hood 47 from the lowered use position shown in FIG. 3, to an elevated non-use position is achieved by the cylinder assembly 85–91, FIG. 3.

Each cylinder assembly includes a lift cylinder 85 pivoted at 87 to a suitalbe bracket 89 upon frame 19 at opposites sides thereof. Each cylinder includes a reciprocal piston rod 91 at its outer end pivoted at 93 to the hood 47.

The vehicle motor 95 controls a suitable hydraulic pump 97 which under the direction of the manually operable or remote control directional valves 99 on frame 19 controls the operation of the cylinder assemblies 85–91 for controlling positioning of hood 47 such as to the use position shown closely adjacent road surface or road bed 13. Referring to FIG. 5, the elongated top wall 103 of the feed carriage 101 has formed therethrough an elongated slot 105 adapted to receive portions of the flexible connector hose 37.

The carriage 101 for the rotating seal and shaft assembly 77 includes an opposed pair of sidewalls 107 normally spaced inwardly from the adjacent opposed sidewalls 108 of hood 47. A pair of opposed elongated channel beams 109 are mounted and secured upon hood sidewalls 108. Mounted upon each of the beams 109 are the opposed vertically aligned guide rails 111 of V-shape.

The vertically aligned laterally spaced pairs of guide wheels 113 with corresponding V grooves 115 are journaled as at 116 upon sidewalls 107 of feed carriage 101 and are guidably positioned for reciprocal movements upon the corresponding guide rails 111, FIG. 5. By this construction the feed carriage 101 which mounts the rotating seal and shaft assembly 77 is adapted for controlled longitudinal transverse reciprocal movements along the "X" axis within the hood 47 which extends transversely across the end of the vehicle 11.

Forming a part of carriage 111 at its lower end is an apertured motor support plate 117. Spanning the aperture in the plate 117 is a mount plate 119 for rotating seal and shaft assembly 77 secured thereunder by a pair of fasteners 121. As shown in FIG. 6, rotating seal mount plate 119 has a central bore 123 adapted to receive the depending power rotated shaft 125 which has a longitudinal or axial bore or passageway 127.

Shaft 125 forms a part of the rotating seal and shaft assembly 77, shown in FIGS. 5 and 6. Referring to FIG. 6, the rotating seal and shaft assembly 77 includes cylindrical body 129 which at its lower end is positioned within the anchor ring 131 inset and welded within an annular groove within the mount plate 119 and secured thereto by a series of spaced radial socket head cap screws 135. Thus, body 129 is held against rotation.

Thrust bearing assembly 137, FIG. 6, is mounted upon the mount plate 119, is positioned within body 129 and axially supports the power rotated shaft 125. The longitudinal passageway 127 has an inlet 165 at is upper end.

A tubular thrust bearing insert or nut 139 is inserted onto shaft 125 where it engages the shoulder 141 of the shaft 125 for completing the assembly and journalling the shaft 125 within body 129 of the rotating seal and shaft assembly 77. The thrust bearing 137 is nested and retained within the bore 143 at the lower end of the body 129.

Portions of the thrust bearing insert 139 loosely nest within the counterbore 145 of body 129. A pair of longitudinally spaced roller bearings 147 are nested within corresponding counterbores 148 within the body 129. The upper bearing 147 guidably receives upper portions of the shaft 125 which is surrounded by the seal 149 within the body.

Adjacent the upper end surface of body 129, there is provided a centrally located cavity 153 through which the shaft 125 extends. Suitable packing 155 surrounds the shaft within cavity 153. A top cover 161 is secured to the body by suitable fasteners 157 and is sealed over the upper end of the body 129. An O-ring seal 159 is provided between cover 161 and the opposing surface of the body 129. The upper end of shaft 125 projects into bore 163 within the seal top cover 161. The corresponding shaft inlet 165 is nested within bore 163 for communication with counterbore 167 of the seal top cover 161 for communication with the secondary conduit 37 connected thereto by the fitting 169 which is threaded into the cover 161, FIG. 6. This provides a means of delivering pressurized water up to 25,000 p.s.i. or as required to perform the work from the manifold 33 into and through the passageway 127 of the power rotated shaft 125.

The enclosing hood 47 of FIG. 5 includes a bottom 171, fragmentarily shown in FIG. 6, which has therein a longitudinal slot 172 which receives the lower end of the shaft 125 as it projects below the hood bottom 171.

Figure 7:
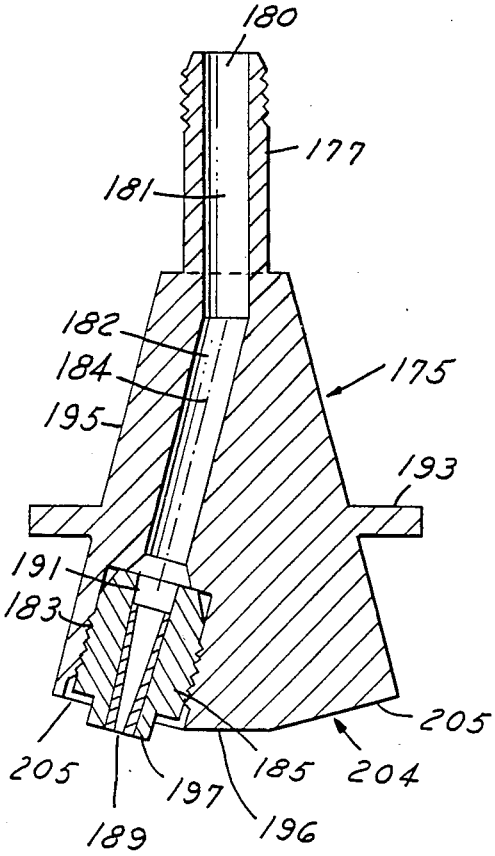
FIG. 7 is a vertical section of a nozzle block adapted for connection to the tubular shaft of the water blaster assembly.
Figure 8:
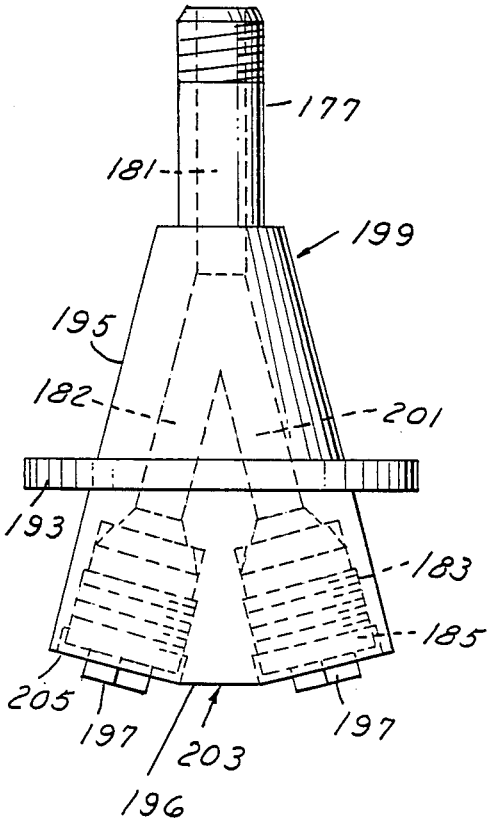
FIG. 8 is a side elevational view of a modified nozzle block including a pair of acute angularly related water passages and orifices.

Rotatable nozzle block 175, fragmentarily shown in FIG. 6, also shown in FIG. 5, and in detail in FIGS. 7 and 8, includes a theaded shank 177 normally arranged in an axial or vertical position which projects into the internal threaded bore 179, FIG. 5, at the lower end of the shaft 125 and includes the integral fastener nut 180 for axially securing the nozzle block 175 to the shaft 125.

Referring to FIG. 7, an elongated nozzle block 175 has an axial fluid bore 181, with an axis 180, in communication with the rotating shaft bore 127, and terminates in the angular elongated bore 182, arranged at an acute angle to bore 181. Angular bore 182 is adapted to receive water under pressures up to, as an example, 25,000 p.s.i. At its outer end it has a counterbore 183 which is internally threaded and arranged along axis 184. The counterbore 183 threadedly receives the nozzle 185 having a replaceable outwardly converging carbide insert 187 which projects outwardly of the end surface 204 of the nozzle block 175, FIG. 7. Insert 187 terminates in the orifice 189. Nozzle 185 has an internal converging bore 191 adapted to frictionally and supportably receive insert 187 providing a means by which the insert 187 and orifice 189 may be replaced when worn.

Arranged around nozzle block 175 intermediate its height is an annular protective shield or flange 193.

The nozzle block 175 includes a diverging body 195 and the end surface 204 which includes a central portion 196 normal to the vertical axis 180. Nozzle 185 terminates in a nut head 197 outwardly of one of the angular end faces 205 of end surface 204. This provides a means to facilitate threaded separation of nozzle 185 from the nozzle block 175 for replacement or for replacement of the carbide insert 187. The angular end faces 205 are also referred to herein as upwardly diverging outer portions 205. One of the end faces or outer portions 205 is normal to the axis of the elongated bore 182.

A modified nozzle block is shown at 199 in FIG. 8, similar in construction to nozzle block 175, FIG. 7. Nozzle block 199 includes a branch longitudinal bore 201 arranged at an acute angle to bore 182 providing for the secondary passage of pressurized fluids towards the end surface 203 of nozzle block 199.

End surfaces 204 and 203 of both of the nozzle blocks 175, 199 respectively include the upwardly tapered or outwardly diverging walls or end faces 205 on opposite sides of the flat central portion 196. The central portion 196 is normal to the vertical axis 180 and the end faces or diverging walls 205 extend at right angles to the corresponding axes of the respective passages 182 and 201. The end faces or portions 205 are at 15° angles to the central portion 196.

By the construction of the nozzle block 199 shown in FIG. 8, there is provided a means by which multiple angularly related water jets may be provided upon the lower end of the shaft 125 to improve the efficiency and effectiveness of the rotating seal and shaft assembly 77 for breaking up and removing structural concrete.

The rotating nozzle assembly including the rotating nozzle block 175, 199 and the nozzle(s) 185 is designed to cut a two inch path as the assembly rotates. The path can be adjusted for a smaller width or a larger width by changing the nozzle block.

Referring to FIGS. 5 and 6, there is shown a power drive assembly for the shaft 125 which is generally indicated at 207, FIG. 5, and includes hydraulic motor 209 whose anchor plate 211 is mounted within and upon motor support plate 117 and suitably secured thereto. The motor drive shaft 213 depends below plate 117 and mounts pulley 215 which, through pulley belt 217, is drivingly connected to a corresponding pulley 219 suitably secured and keyed upon the shaft 125, FIGS. 5 and 6. The detail of a pulley anchor is shown at 221, FIG. 6.

The power drive for the shaft 125 is closely adjacent the rotating seal and shaft assembly 77 such as shown in FIG. 5, with power directed to the shaft 125 by the corresponding pulleys 215, 219 and pulley belt 217.

Figure 10:
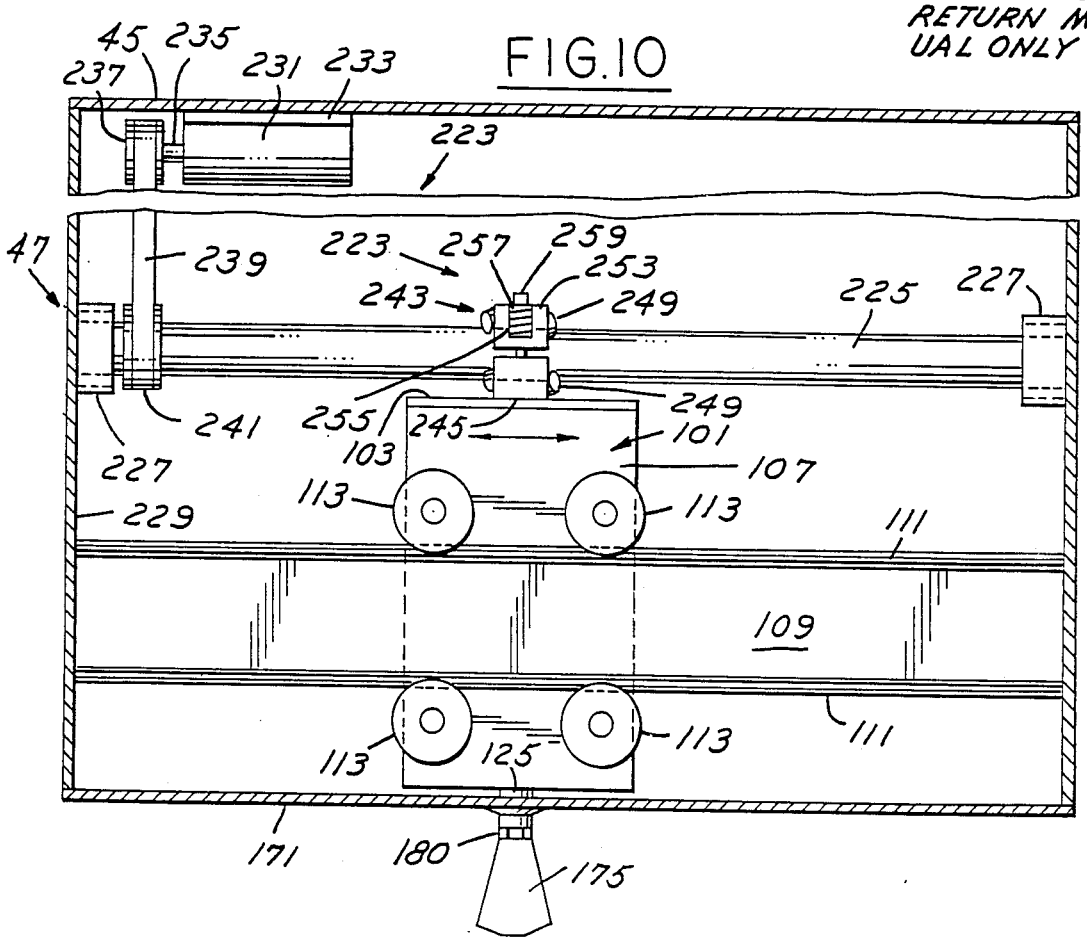
FIG. 10 is a fragmentary partially sectioned elevational view of the hood and the carriage drive therein for the water blaster apparatus.

Feed mechanism for the carriage 101 is shown in further detail in FIGS. 5 and 10 and is generally indicated at 223. Elongated drive shaft or tube 225 is journaled and supported at its ends within bearings 227 located upon end walls 229 of the hood 47 and is arranged centrally of the hood.

Reversible electric motor 231, FIG. 10, preferably of constant speed, and reversible, though variable speed is possible, is anchored at 233 on the top wall 45 of the hood 47. The motor 231 includes a drive shaft 235 connected by sprocket 237 and chain 239 and corresponding sprocket 241 to feed shaft 225, FIG. 10. A threadless nut assembly 243, sometimes referred to as a power spiral operator or actuator provides the means of transmitting rotary motion of shaft 225 to longitudinal movement of carriage 101.

In this construction and as shown in FIGS. 5 and 10, there is provided a first roller support block 245 having an anchor plate 247 upon the undersurface of the carriage cover 103. Block 245 mounts upon its opposite sides pairs of skewed rollers 249 whose axes of rotation are arranged at acute angles with respect to each other and which extend angularly upwardly and downwardly and are spaced apart. A portion of the first roller support block 245 is centrally cut away at 246 to receive a lower portion of the feed shaft 225. Respective skewed rollers 249 are journaled at 251 upon opposite sides of the upright support block 245.

Overlying the support block 245 is a top roller support block 253 which is similarly cut away at 246 to correspondingly receive an upper portion of feed shaft 225. Shown in FIG. 10, upon opposite ends of the top support block 253 are upright slots 255 which next compression springs 257 and receive adjustable fasteners 259 which extend through the springs and are adjustably threaded down into the first roller support block 245. Supportably mounted upon the top support block 253 upon its opposite sides are additional pairs of angularly skewed rollers 249 similarly journaled and mounted upon block 253 laterally spaced and skewed with respect to the other rollers upon the lower support block so as to engage around the feed shaft 225.

The arrangement of the skewed rollers 249 with respect to the shaft 225 and the frictional engagement therewith is such that power rotation of shaft 225 is adapted to effect longitudinal feed movements of the corresponding roller support blocks 245 and 253 and the connected carriage 101. By this construction, the carriage 101 is reciprocally fed along the length of feed shaft 125 which corresponds to the "X" axis.

The feed mechanism, sometimes referred to as a power spiral operator, presents a method for translating rotary motion of shaft 225 to linear motion of carriage 101. The actuator travels along the shaft by means of skewed rollers 249 which frictionally engage the shaft. In principal it may be compared to a nut traveling on a threaded shaft, except there are no threads involved.

Due to the frictional engagement of the rollers to the shaft 225, output force may be increased by increasing the pressure of engagement. This can be achieved by adjusting the fasteners 259 and in turn the compression in the corresponding springs 257. Likewise, because of such frictional engagement, any resistance to movement of the actuator greater than its output force will cause the rollers to slip or float on the shaft 225 and the actuator to stall while the shaft 225 continues to turn.

Reversal of the shaft rotation will reverse the direction of actuator travel. Accordingly, the drive motor 231 is reversible under remote, manual or automatic control so that the carriage 101 will feed in one direction along the length of the hood 47 and will reverse to feed in the opposite direction along the "X" axis.

The power spiral operator 243 requires no lubrication of any type. It is therefore virtually maintenance free. Compared to pneumatic and hydraulic systems, bulkness, and the complexity of available electric actuators, the present power spiral operator 243 is a mechanical device capable of withstanding extreme working conditions.

In the illustrative embodiment, the lead provided is 3" per single revolution of shaft 225. The thrust can be controlled between 0 and 600 pounds by regulating the amount of frictional engagement of the skewed feed rollers 249 with respect to shaft 225.

Figure 9:
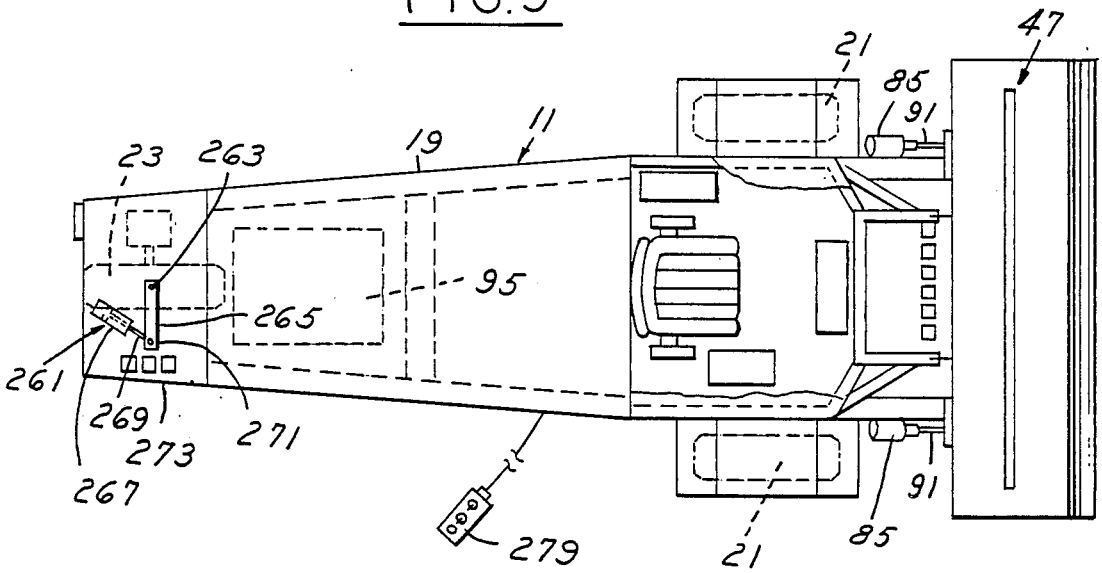
FIG. 9 is a plan view of the control support vehicle for the water blaster apparatus shown in FIG. 1.

Referring to FIG. 9, a steering assembly 261 is shown under remote control at 275, FIG. 3, controlling the angularity of the single steering wheel 23 upon vertical axis 263. Yoke support 262, FIG. 3, for the wheel 23 is mounted upon vertical axis 263, FIG. 9, for rotation from the central position shown. Elongated steering arm 265 at one end is connected to wheel support 262 at the vertical axis of rotation 263.

The cylinder assembly includes a cylinder 267 which is pivotally mounted at 268 to a portion of the vehicle frame on a vertical axis and includes a reciprocal piston rod 269 which at its outer end is pivotally connected as at 271 to steering arm 265.

A series of remote control valves 723 are shown in FIG. 9, controlling operation of the hydraulic cylinder 267. One form of manual control for steering is shown at 275, FIG. 3, whereby the activation of the respective control valves 273 will determine the positioning of piston rod 269 with respect to cylinder 267 such as will turn the wheel 23 in one direction or the other from the central position shown in FIG. 9. It may be under manual control at 275, FIG. 3. Also shown at 277 is a manual remote control for forward and reverse for effecting incremental forward or reverse feed movements of the vehicle 11 over the road surface 13.

A further remote control is shown at 279, FIG. 9, with sufficient buttons for effecting the remote control of manual steering and remote control of incremental forward feed movements of the vehicle.

The concrete blaster guides the traverse motion of the rotating high pressure nozzle. The concrete blaster vehicle 11 has a hood length for a 78 inch wide cut or a hood length for a 156 inch wide cut, measured along the "X" axis.

The high pressure nozzle rotation is important to high productivity and efficiency. This system is designed to remove up to 200 square feet, one inch deep of material per hour. This is equivalent to 30 laborers using jackhammers.

The nozzle assembly 175 is mounted to the carriage which rides within the hood 77. After the rotating seal and shaft assembly has completed a preset number of strokes, the machine indexes automatically a distance which corresponds to the width of the cut. This design moves the nozzle in a circular path at high speed as it advances—producing much higher efficiency than prior art stationary nozzles.

Repetitive passes of the rotating nozzle assembly over the same concrete material is made until the material is cleanly blasted away, at which time the longitudinal travel of the machine is advanced. The number of passes, and pass direction, nozzle blast diameter and travel advance distance data is predetermined based on test strip information.

MODIFICATION

Figure 4:
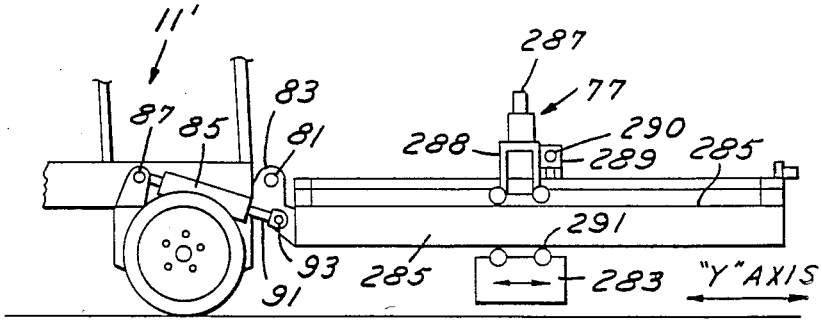
FIG. 4 is a fragmentary view of a modified water blaster vehicle, with the hydraulic motor and cylinder mounted on the frame for incremental movement along the "X" axis and for incremental movement along the "Y" axis.

A modification of the water blaster vehicle 11 is shown in FIG. 4. The modified hood assembly 281 contains the X-axis and is arranged for movement along the guide rails 285 which are parallel to the Y-axis.

A hydraulic drive motor in the form of the rotating-seal and shaft assembly 77 described previously is mounted for rotary movement along the X-axis as described previously. A hydraulic cylinder 287 is connected to the rotating shaft of the drive motor.

The raising and lowering by the cylinder assembly 85, 91 is the same as described with respect to FIG. 3. The carriage designated at 283 for moving the power motor drive assembly 77 along the Y-axis is mounted upon the guide rails 285 employing guide rollers 291 similar to guide rollers 113, described with respect to FIGS. 5 and 10. The rotating shaft and seal assembly 77 is attached to a threadless drive nut 289 for movement along the pipe or rod 290 in the direction of the X-axis.

Figure 11:
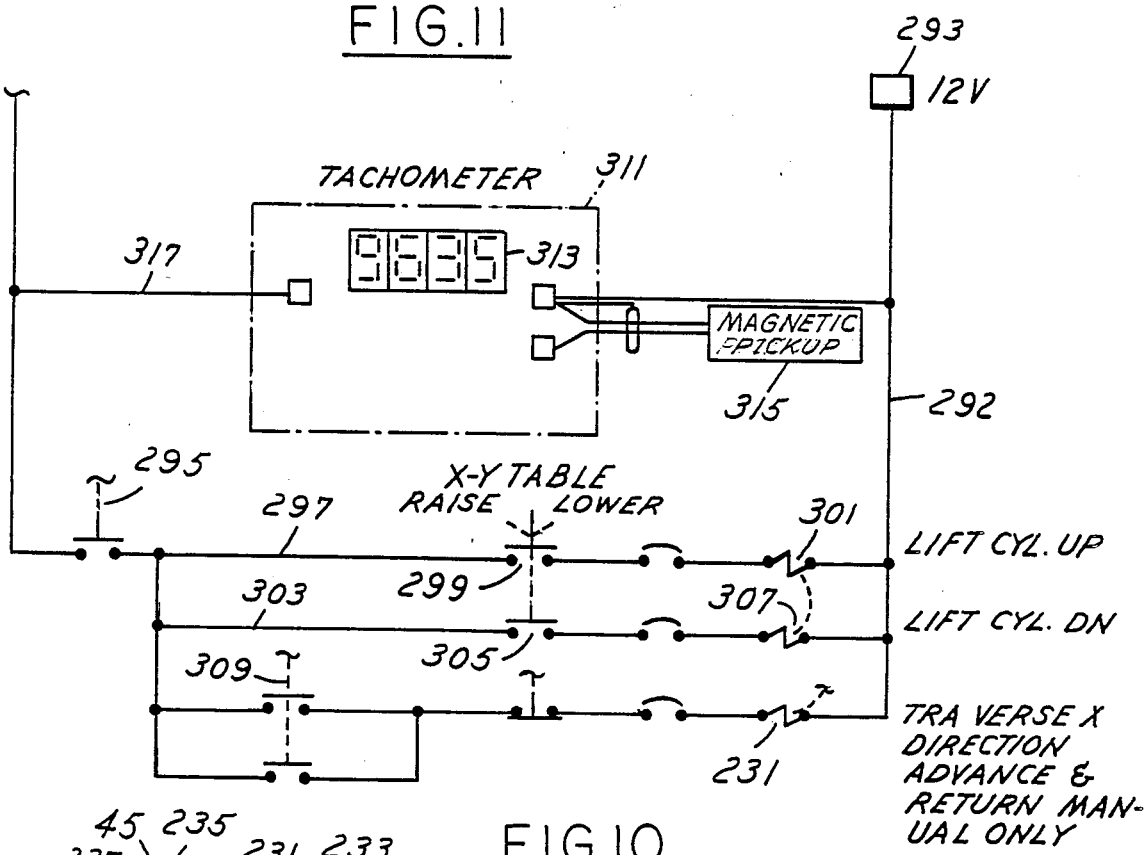
FIG. 11 is a schematic circuit diagram illustrating the controls for the hood and for traverse reciprocal movements of the water blaster assembly shown in FIG. 10.

The electrical circuit 292 shown in FIG. 11 illustrates the controls for traverse reciprocal movements of the carriage and the rotation seal assembly 77. A suitable 12 volt power source 293 is shown for the circuit which includes off-on switch 295 and branch lead 297 connected to manual switch 299 for controlling solenoid 301 directed to one of the valves 99, FIG. 3, for controlling the lift cylinder 85 for effecting an advance movement of piston rod 81 and a lifting of the hood 47.

Branch lead 303 includes manual switch 305 for controlling the solenoid 307 directed to one of the control valves 99 for cylinder 85 for causing retraction of the piston rod such as would lower the hood 47 to the use position shown in down position, FIG. 3. Double acting traverse and reverse switch 309 forms a part of the circuit 291 and is connected to motor 231 for controlling electric power for manual control of the advance and return of feed assembly or power spiral operator 243 for carriage 101, FIGS. 5 and 10.

Also shown in FIG. 11 within circuit 292 is a tachometer 311 having a numerical readout at 313 connected by lead 317 into circuit 291 and the magnetic pick-up 315 adapted for registry with the shaft 125 of the rotating seal assembly 77 counting rotations of the shaft.

Normally, in the use of the water blaster vehicle 11, FIG. 1, there is associated with respect to high pressure water outlet 75 (FIG. 2) the usual dump valve assembly by which water is recirculated between the tank and the pump until water is to be directed to the flexible conduit 29 to the pressure water manifold. Under those circumstances, a suitable electrical control reverses the dump valve so that full pressure flow up to 25,000 p.s.i., as an example, is available through conduit 29 to the rotating seal and shaft assembly 77.

The present invention is also directed to the method of removing structural concrete from a road bed which comprises the following steps:

(1) Mounting a vehicle apparatus 11 upon a road bed 13 for longitudinal intermittent incremental forward feed movements thereover;

(2) Pivotally supporting a hood 47 upon the vehicle apparatus having a lowered position closely adjacent the road bed and an elevated position;

(3) Positioning a water pressure manifold 33 upon the vehicle apparatus 11 connected to a source of pressurized water as through conduit 29 and conduit 37;

(4) Movably and reciprocally mounting a feed carriage 101 within and upon hood 47;

(5) Mounting a rotating seal and shaft assembly 77 upon the carriage 101 including a depending power rotated shaft 125; and (6) Supporting at least one nozzle block 175 having an angular bore 182 and an orifice 185 for connection to and rotation within the shaft 125 for sequentially penetrating and pulverizing the concrete of a roadway, for illustration, by impingement of high pressure rotating water jets upon the concrete with the rotating seal and shaft assembly 77 reciprocating back and forth over the work area removing structural concrete to a required depth and for removing surface scale and corrosion from the concrete reinforcing rebars, and successively advancing the apparatus over the road bed. The nozzle block may have at least one additional orifice 185, FIG. 8.

The sequential penetrating and pulverizing action of the high pressure rotating water jets entering between and beneath the aggregate particles, not only removes the concrete immediately surrounding embedded reinforcing bars, but also effectively removes surface scale and corrosion from such bars, conditioning them to form a strong bond with fresh concrete to be poured around them.

The incident angle of the rotational water jets to the concrete surface may be varied by varying at different angles of the delivery passages 182 with respect to vertical axis 181. This enhances the removal action in places otherwise difficult to reach such as beneath and behind reinforcing bars or composites of such bars.

Having described our invention, reference should now be had to the following claims:

We claim:

1. The method of removing structural concrete from a road bed comprising:

mounting a vehicle apparatus upon a road bed for longitudinal intermittent incremental forward feed movements thereover;

pivotally supporting a hood upon the vehicle apparatus having a lowered position closely adjacent the road bed and an elevated position;

positioning a conduit connected to a source of water under pressure in the range up to 25,000 p.s.i.;

movably mounting a feed carriage upon and within said hood for transverse reciprocal movements along the length of said hood;

mounting a rotating seal and shaft assembly upon said feed carriage including a power rotated tubular shaft having a water inlet;

supporting at least one nozzle block having an angular bore and an orifice for connection to and rotation with said shaft;

connecting the conduit to the water inlet of the shaft; and reciprocating the feed carriage within the hood while simultaneously rotating the seal and shaft assembly and the nozzle thereby sequentially penetrating and perforating the concrete by impingement of high pressure rotating water jets upon the concrete, removing the structural concrete to a required depth and removing surface scale and corrosion from the concrete reinforcing bars.

2. Apparatus for removing structural concrete comprising a vehicle having a frame and wheels movable upon and along a road bed;

a transversely extending elongated hood pivotally mounted upon one end of the frame having a lowered position closely adjacent the road bed and an elevated position;

a conduit adapted to be connected on one end to a source of water under pressure;

a feed carriage guidably mounted within and upon said hood for longitudinal reciprocal movements along the length of said hood;

a rotating seal and shaft assembly including an upright body having a water inlet mounted within and upon said carriage;

said conduit having its other end connected to said water inlet;

an upright rotatable tubular shaft journaled and supported within said body and depending therefrom below said carriage and hood, at one end communicating with said water inlet;

a nozzle block having an end face and a tubular shank on a vertical axis projected into and secured within and communicating with the other end of said shaft and including an elongated bore extending to the end of said block at an acute angle to said axis;

a nozzle having a converging orifice communicating with said bore and secured within said nozzle block and outletting at its end face; and power means on said carriage connected to said tubular shaft for rotating same and said nozzle;

said hood having an elongated slot in its top along the length thereof, through which said conduit extends, said conduit moving along the length of said slot on reciprocal movements of said feed carriage;

the sequential and pulverizing action of water in a rotating pattern discharged from said rotating nozzle impinging against the concrete under high pressure as the feed carriage is moved back and forth over the work area resulting in the water removing structural concrete to a required depth and removing surface scale and corrosion from the concrete reinforcing bars without damage thereto.

3. In the apparatus for removing structural concrete of claim 2, the support and journaling of said tubular shaft including a thrust bearing mounted upon said carriage nested within said body surrounding and axially supporting said shaft; and a plurality of longitudinally spaced roller bearings upon said body guidably receiving said shaft along its length.

4. In the apparatus for removing structural concrete of claim 2, said body of said rotating seal assembly including a cover including said water inlet and an axial bore;

there being a counterbore within said body adjacent said axial bore, through which said tubular shaft projects; and a housing seal with packing nested in said counterbore and sealed therein and with respect to said cover.

5. In the apparatus for removing structural concrete of claim 2, said nozzle having an inwardly converging bore retainingly receiving said orifice;

said orifice converging at its outer end defining a high pressure, high velocity flow of water to impinge upon said concrete.

6. In the apparatus for removing structural concrete of claim 2, said nozzle being exteriorily threaded for registry within a corresponding bore in said nozzle block; and a projecting nut head upon the outer end of said nozzle.

7. In the apparatus for removing structural concrete of claim 2, an annular shield flange mounted upon and extending around said nozzle block intermediate its height.

8. In the apparatus for removing structural concrete of claim 2, there being a second elongated bore extending to the end of said block on an axis at an acute angle to said elongated bore;

both of said elongated bores communicating with the shaft of said rotating seal and shaft assembly; and a second nozzle having a converging orifice communicating with said second bore and secured within said second nozzle block and outletting at its end face.

9. In the apparatus for removing structural concrete of claim 8, the end face of said nozzle block having a central portion normal to said vertical axis and an upwardly diverging outer portion normal to the axes of said elongated bores.

10. In the apparatus for removing structural concrete of claim 2, said wheels including a pair of laterally spaced wheels adjacent one end of said frame, and a single centrally arranged steering wheel adjacent the other end of said frame, yoke means rotatively supporting the steering wheel for rotation about a vertical axis;

a steering arm upon a horizontal axis underlying said frame, at one end secured to said yoke means; and a hydraulic cylinder underlying said frame at one end pivotally mounted thereon, including a reciprocal piston rod at its end connected to and supporting the other end of said steering arm;

said piston rod having a central neutral position, a retracted position for turning the steering wheel in one direction from a central position and an advanced position for turning the steering wheel in the opposite direction from a central position.

11. In the apparatus for removing structural concrete of claim 10, a series of control valves connected to a source of hydraulic pressure fluid and to opposite ends of said cylinder for regulating the position of said piston rod controlling said steering wheel.

12. In the apparatus for removing structural concrete of claim 2, said feed carriage having an apertured motor support plate;

said power means on said carriage including a motor spaced from said rotating seal body and mounted upon said support plate and including a depending upright drive shaft;

a mount plate spanning the aperture in said support plate and secured thereto;

said rotating seal body being anchored upon said mount plate;

said tubular shaft depending from said mount plate;

spaced pulleys upon said drive shaft and said tubular shaft; and a belt interconnecting said pulleys.

13. In the apparatus for removing structural concrete of claim 12, said motor being a hydraulic motor; and remote control means for reversing the direction of rotation of said hydraulic motor.

14. In the apparatus for removing structural concrete of claim 13, and further remote control means for modifying the speed of rotation of said hydraulic motor whereby said nozzle motion and feed motion of said rotating seal and shaft assembly are variable for effecting cutting of said concrete.

15. In the apparatus for removing structural concrete of claim 12, the anchoring of said rotating body upon said mount plate including an anchor ring nested and retained within an annular groove in said mount plate; and a plurality of spaced radial fasteners extending through said ring and into said body.

16. Apparatus for removing structural concrete comprising a vehicle having a frame and wheels movable upon and along a road bed;

a transversely extending elongated hood pivotally mounted upon one end of the frame having a lowered position closely adjacent the road bed and an elevated position;

a feed carriage guidably mounted within and upon said hood for longitudinal reciprocal movements along the length of said hood;

a rotating seal and shaft assembly including an upright body having a water inlet adapted to be connected to a source of water under pressure, said seal and shaft assembly being mounted within and upon said carriage;

an upright rotatable tubular shaft journaled and supported within said body and depending therefrom below said carriage and hood, at one end communicating with said water inlet;

a nozzle block having an end face and a tubular shank on a vertical axis projected into and secured within and communicating with the other end of said shaft and including an elongated bore extending to the end of said block at an acute angle to said axis;

a nozzle having a converging orifice communicating with said bore and secured within said nozzle block and outletting at its end face;

power means on said carriage connected to said tubular shaft for rotating same;

the sequential and pulverizing action of water in a rotating pattern impinging against the concrete under high pressure and traveling back and forth over the work area removing structural concrete to a required depth and removing surface scale and corrosion from the concrete reinforcing bars without damage thereto;

said hood having opposed spaced sidewalls;

said feed carriage including spaced opposed sidewalls and a top wall;

the mounting of said feed carriage including opposed beams upon and along the interior of said hood sidewalls;

aligned guide rails along the top and bottom of each beam; and vertically spaced pairs of laterally spaced guide wheels journaled upon each of the sidewalls of said carriage and in cooperative registry with said guide rails respectively.

17. In the apparatus for removing structural concrete of claim 16, said source of water under pressure including a water storage and pump vehicle movable on the road bed and including a bed;

a water storage tank on the bed;

a power operated pump connected to the tank;

a pump discharge manifold connected to the tank and having a high pressure water outlet on the vehicle; and an elongated flexible hose having fittings on its ends for connection respectively to said water outlet and to said water inlet.

18. In the apparatus for removing structural concrete of claim 16, said guide rails being V-shaped, said guide wheels having V-shaped annular grooves therein receiving said rails.

19. In the apparatus for removing structural concrete of claim 16, the pivot mounting of said hood including a pair of laterally spaced brackets on and forwardly of said one end of said frame;

a pair of laterally spaced hood supports upon said hood pivotally connected to said brackets respectively;

a pair of spaced lift cylinder assemblies upon opposite sides of said frame;

each cylinder assembly including a cylinder pivotally mounted upon said frame and a reciprocal piston rod on said cylinder pivotally connected to said hood;

the controlled advance of said piston rods pivoting said hood to an elevated position and retraction of said piston rods moving said hood to its lowered position.

20. In the apparatus for removing structural concrete of claim 19, and manually operable switch control means for selectively advancing and retracting said piston rods.

21. Apparatus for removing structural concrete comprising a vehicle having a frame and wheels movable upon and along a road bed;

a transversely extending elongated hood pivotally mounted upon one end of the frame having a lowered position closely adjacent the road bed and an elevated position;

a feed carriage guidably mounted within and upon said hood for longitudinal reciprocal movements along the length of said hood;

a rotating seal and shaft assembly including an upright body having a water inlet adapted to be connected to a source of water under pressure, said seal and shaft assembly being mounted within and upon said carriage;

an upright rotatable tubular shaft journaled and supported within said body and depending therefrom below said carriage and hood, at one end communicating with said water inlet;

a nozzle block having an end face and a tubular shank on a vertical axis projected into and secured within and communicating with the other end of said shaft and including an elongated bore extending to the end of said block at an acute angle to said axis;

a nozzle having a converging orifice communicating with said bore and secured within said nozzle block and outletting at its end face;

power means on said carriage connected to said tubular shaft for rotating same;

the sequential and pulverizing action of water in a rotating pattern impinging against the concrete under high pressure and traveling back and forth over the work area removing structural concrete to a required depth and removing surface scale and corrosion from the concrete reinforcing bars without damage thereto;

said feed carriage having a top wall;

the reciprocal movements of said feed carriage including an elongated power rotated shaft extending the length of said hood centrally thereof and at its end journaled upon said hood;

a bottom roller support block mounted upon said top wall, recessed to receive said shaft;

a top roller support block yieldably mounted upon and aligned with and secured to said bottom support block and recessed to receive said shaft; and spaced pairs of angularly skewed carriage feed rollers journaled upon said bottom and top blocks respectively in frictional engagement with said shaft, whereby rotation of said shaft in one direction feeds the carriage in one direction and rotation of said shaft in the opposite direction feeds said carriage in the opposite direction.

22. In the apparatus for removing structural concrete of claim 21, the yieldable mounting of said top block including a pair of headed fasteners within said top block and threaded into said bottom block; and a coiled compression spring on each fastener interposed between said fastener head and said top block yieldably biasing said top block toward said bottom block;

adjustment of said fasteners and spring compression adapted to vary the frictional forces of said rollers upon said shaft in turn varying the feeding forces for said carriage.

23. In the apparatus for removing structural concrete of claim 21, the drive for said feed shaft including a reversible electric motor mounted within and upon said hood and having a drive shaft coupled to said feed shaft; and reversible control means connected to said motor for reversing direction of rotation of its drive shaft.

24. In the apparatus for removing structural concrete of claim 21, there being additional sets of spaced pairs of skewed feed rollers journaled upon the opposite sides of said blocks in registry with said power rotated shaft.

25. Apparatus for removing structural concrete comprising a vehicle having a frame and wheels movable upon and along a road bed;

a traversely extending elongated hood pivotally mounted upon one end of the frame having a lowered position closely adjacent the road bed and an elevated position;

a feed carriage guidably mounted within and upon said hood for longitudinal reciprocal movements along the length of said hood;

a rotating seal and shaft assembly including an upright body having a water inlet adapted to be connected to a source of water under pressure, said seal and shaft assembly being mounted within and upon said carriage;

an upright rotatable tubular shaft journaled and supported within said body and depending therefrom below said carriage and hood, at one end communicating with said water inlet;

a nozzle block having an end face and a tubular shank on a vertical axis projected into and secured within and communicating with the other end of said shaft and including an elongated bore extending to the end of said block at an acute angle to said axis;

a nozzle having a converging orifice communicating with said bore and secured within said nozzle block and outletting at its end face;

power means on said carriage connected to said tubular shaft for rotating same;

the sequential and pulverizing action of water in a rotating pattern impinging against the concrete under high pressure and traveling back and forth over the work area removing structural concrete to a required depth and removing surface scale and corrosion from the concrete reinforcing bars without damage thereto;

said feed carriage having an apertured motor support plate;

said power means on said carriage including a motor spaced from said rotating seal body and mounted upon said support plate and including a depending upright drive shaft;

a mount plate spanning the aperture in said support plate and secured thereto;

said rotating seal body being anchored upon said mount plate;

said tubular shaft depending from said mount plate;

spaced pulleys upon said drive shaft and said tubular shaft;

a belt interconnecting said pulleys;

said hood having a bottom wall through which said tubular shaft projects, said bottom wall being apertured to receive said tubular shaft; and a seal mounted upon said bottom wall loosely receiving said shaft, protecting the interior of said hood from water and debris.

* * * * *